US006709489B2

(12) United States Patent
Ament et al.

(10) Patent No.: US 6,709,489 B2
(45) Date of Patent: Mar. 23, 2004

(54) MICROWAVE REGENERATED DIESEL PARTICULATE TRAP

(75) Inventors: Frank Ament, Troy, MI (US); Eugene Victor Gonze, Pinckney, MI (US)

(73) Assignee: General Motors Corporation, Detroit, MI (US)

( * ) Notice: Subject to any disclaimer, the term of this patent is extended or adjusted under 35 U.S.C. 154(b) by 124 days.

(21) Appl. No.: 10/003,688

(22) Filed: Nov. 15, 2001

(65) Prior Publication Data

US 2002/0092422 A1 Jul. 18, 2002

Related U.S. Application Data

(60) Provisional application No. 60/256,075, filed on Dec. 15, 2000.

(51) Int. Cl.[7] ..... B01D 46/00

(52) U.S. Cl. ..... 95/278; 55/282.3; 55/385.3; 55/523; 55/524; 55/DIG. 10; 55/DIG. 30

(58) Field of Search ..... 55/282.3, 385.3, 55/523, 524, DIG. 10, DIG. 30; 95/1, 19, 20, 278; 60/311

(56) References Cited

U.S. PATENT DOCUMENTS

| | | | | |
|---|---|---|---|---|
| 5,074,112 | A | * 12/1991 | Walton et al. | 60/311 |
| 5,087,272 | A | * 2/1992 | Nixdorf | 55/DIG. 30 |
| 5,180,559 | A | * 1/1993 | Ma | 55/DIG. 30 |
| 5,194,078 | A | * 3/1993 | Yonemura et al. | 55/523 |
| 5,195,317 | A | * 3/1993 | Nobue et al. | 55/DIG. 30 |
| 6,328,779 | B1 | * 12/2001 | He et al. | 55/523 |
| 6,379,407 | B1 | * 4/2002 | Blackwell et al. | 55/282.3 |
| 6,461,398 | B2 | * 10/2002 | Peters et al. | 55/523 |
| 6,540,816 | B2 | * 4/2003 | Allie et al. | 95/278 |

* cited by examiner

*Primary Examiner*—Duane Smith
*Assistant Examiner*—Jason M. Greene
(74) *Attorney, Agent, or Firm*—Christopher DeVries

(57) ABSTRACT

A method and apparatus for initiating regeneration in a particulate trap including the steps of locating microwave-absorbing material in the particulate trap in areas that particulates build up, generating microwaves, absorbing microwaves with the microwave-absorbing material, and controlling the microwaves to initiate a burn-off of particulates.

12 Claims, 10 Drawing Sheets

MICROWAVE REGENERATED DIESEL PARTICULATE TRAP

This application claims priority from U.S. Provisional Application No. 60/256,075 filed Dec. 15, 2000.

TECHNICAL FIELD

The present invention relates to a diesel particulate trap. More specifically, the present invention relates to a method and apparatus for regenerating a diesel particulate trap using microwave radiation.

BACKGROUND OF THE INVENTION

Increased regulation has reduced the allowable levels of particulates generated by diesel engines. The particulates can generally be characterized as a soot that is captured and reduced by particulate filters or traps. Present particulate filters or traps contain a separation medium with tiny pores that capture particles. As trapped material accumulates in the particulate trap, resistance to flow in the particulate trap increases, generating back pressure. The particulate trap must then be regenerated to burn off the particulates/soot in the particulate trap to eliminate the back pressure and allow air flow through the particulate trap. Past practices of regenerating a particulate trap utilized an energy source such as a burner or electric heater to generate combustion in the particulates. Particulate combustion in a diesel particulate trap by these past practices has been found to be difficult to control and may result in an excessive temperature rise.

SUMMARY OF THE INVENTION

The present invention is a method and apparatus for regenerating a particulate trap using microwave energy. The present invention directs microwaves to select locations in a particulate trap such as near an inlet channel end plug of a particulate trap to initiate regeneration and prevent particulate build-up. By directing microwaves to select locations, a relatively small amount of energy initiates the particle combustion that regenerates the particulate trap. The exotherm or combustion of a small amount of particulates is leveraged to burn a larger number of particulates.

The present invention includes a particulate trap placed in the exhaust flow of a diesel engine. The particulate trap includes microwave-absorbing materials configured to absorb microwaves in selected locations in the particulate trap. A microwave source is operatively coupled to a wave guide, and a focus ring may be used to direct the microwaves to the microwave-absorbing materials. The microwave-absorbing material generates heat in response to incident microwaves to burn off particulates. Materials transparent to microwaves are preferably used for the basic construction of the particulate trap housing and other areas in the particulate trap where it would be inefficient to absorb microwave energy.

In the present invention, the microwave reflecting and guiding materials are configured to guide and reflect the microwaves until they are incident upon the microwave-absorbing material. The microwaves in effect "bounce" around the particulate trap until they are incident upon the microwave-absorbing materials. By strategically locating microwave-absorbing materials, microwaves may be used efficiently at the locations they are most needed to initiate the burn off of particulates.

The use of microwaves in the present invention further allows the frequency of particulate trap regeneration to be precisely controlled. The present invention may schedule regenerations based on empirically-generated particulate trap operation data and/or utilize a pressure sensor to determine when the particulate trap requires a regeneration.

DESCRIPTION OF THE PREFERRED EMBODIMENT

Figure 1:
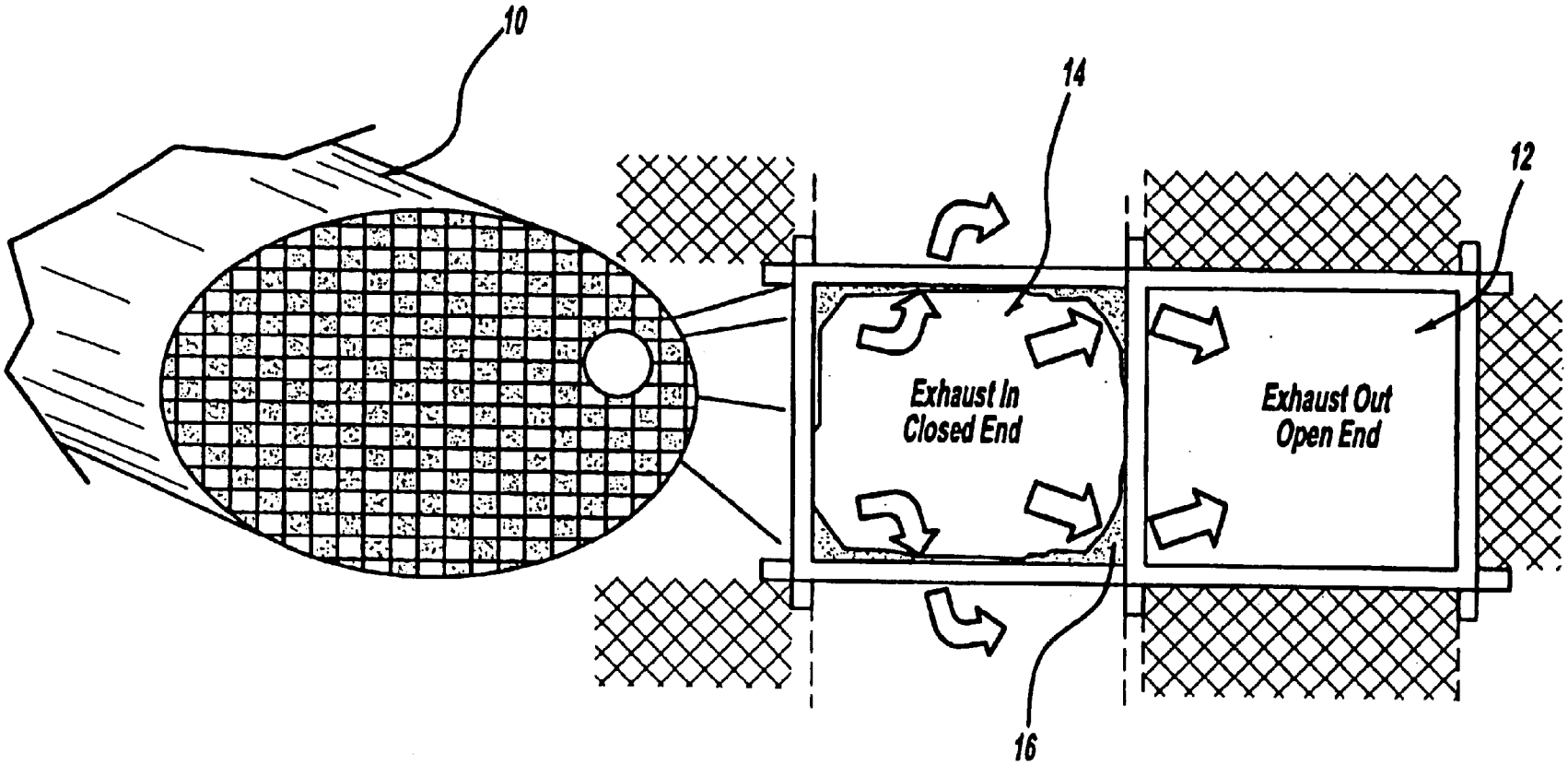
FIG. 1 is a diagrammatic drawing of a wall flow monolith particulate trap.
Figure 2:
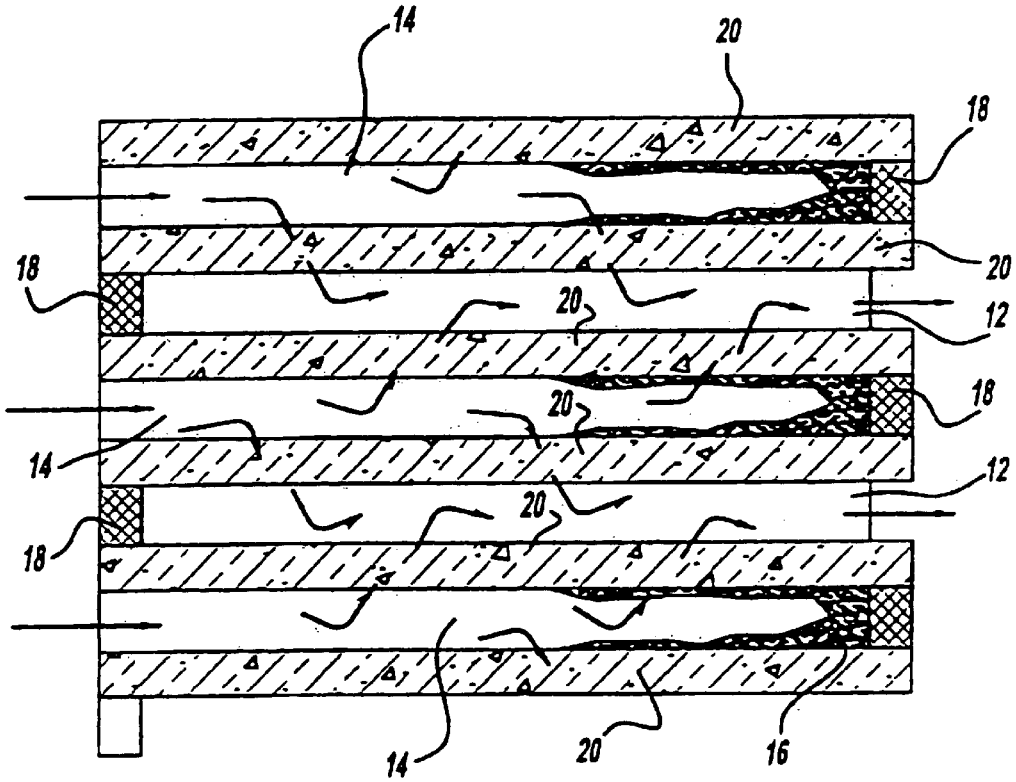
FIG. 2 is a diagrammatic drawing illustrating the exhaust flow through a particulate trap.

FIG. 1 is a diagrammatic drawing of a typical wall flow monolith particulate trap 10 "particulate trap" used in diesel applications. The particulate trap 10 includes alternating closed cells/channels 14 and open cells/channels 12. Exhaust gases such as those generated by a diesel engine enter the closed end channels 14 depositing particulate matter 16 and exit through the open channels 12. Referring to FIG. 2, a more detailed view of the exhaust flow through closed end 14 and open end 12 channels can be seen. Plugs 18 are used to seal the ends of the channels 12 and 14. The walls 20 of the particulate trap are preferably comprised of a porous ceramic honeycomb wall of cordierite material, but any ceramic honeycomb material is considered within the scope of the present invention.

Figure 3:
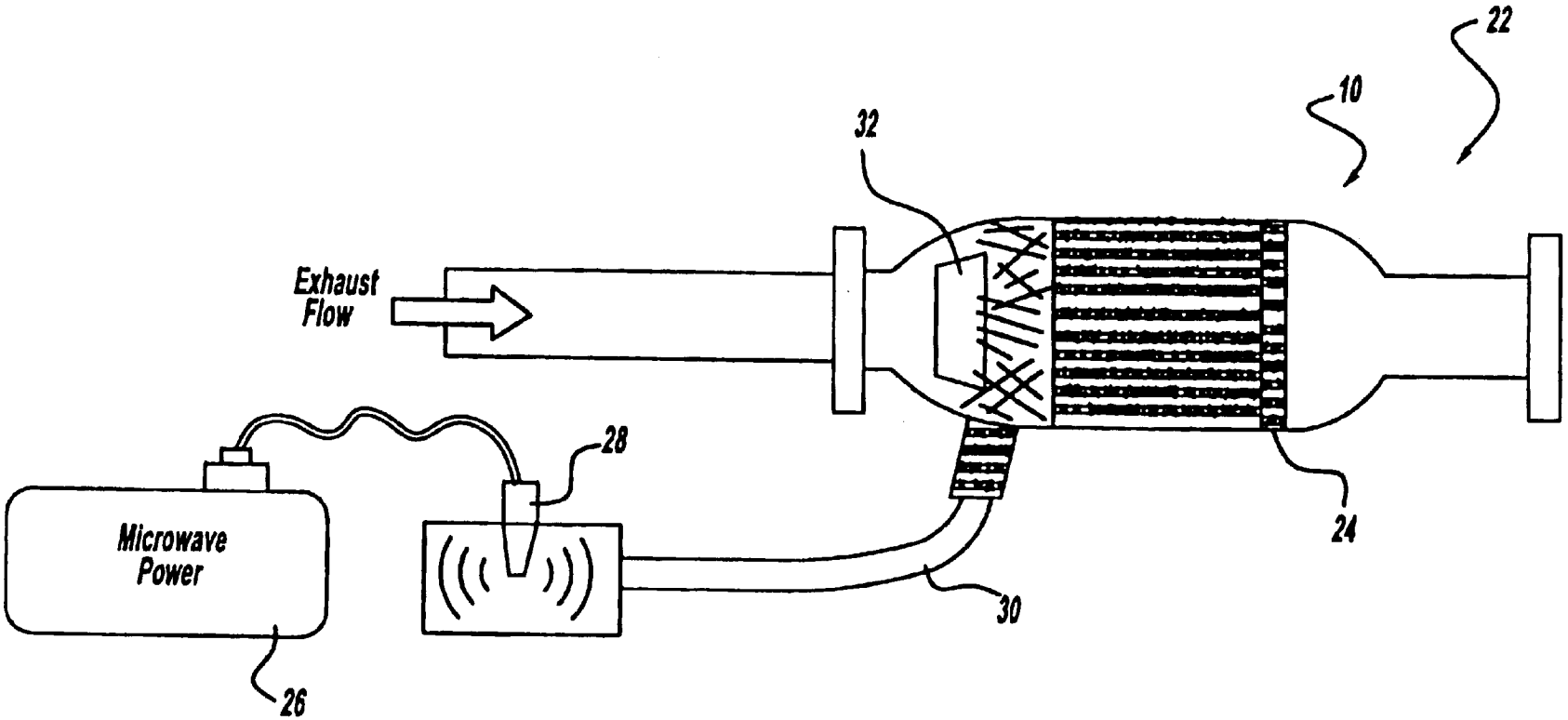
FIG. 3 is a diagrammatic drawing of the microwave regeneration system of the present invention.

FIG. 3 is a diagrammatic drawing of the microwave system 22 of the present invention. The system 22 includes a particulate trap 10 placed in the exhaust flow of a diesel engine. The particulate trap 10 includes a microwave-absorbing material 24 such as silicon carbide configured to absorb microwaves in selected locations in the particulate trap 10, but any known microwave-absorbing materials are considered within the scope of the present invention. A microwave power source 26 and microwave antenna 28 are operatively coupled to a wave guide 30 and an optional focus ring 32 to direct the microwaves to the microwave-absorbing material 24. In alternate embodiments of the present invention, the microwave antenna 28 is directly coupled to the housing of the particulate trap 10. The microwave-absorbing material 24 generates heat in response to incident microwaves to initiate the burn-off of particulates in the particulate trap 10. Materials such as cordierite that are transparent to microwaves are preferably used for the basic construction of the particulate trap 10 housing and other areas in the particulate trap 10 where it would be inefficient to absorb microwave energy. As the cordierite does not absorb microwave energy, the microwaves will "bounce" around until they are incident upon the microwave-absorbing material 24. The channels 12 and 14 are further configured to guide the microwaves to the microwave-absorbing material 24. The temperature of the particulate trap 10 may be regulated by the properties and location of the microwave-absorbing materials and by controlling the application of the microwave energy.

Figure 5:
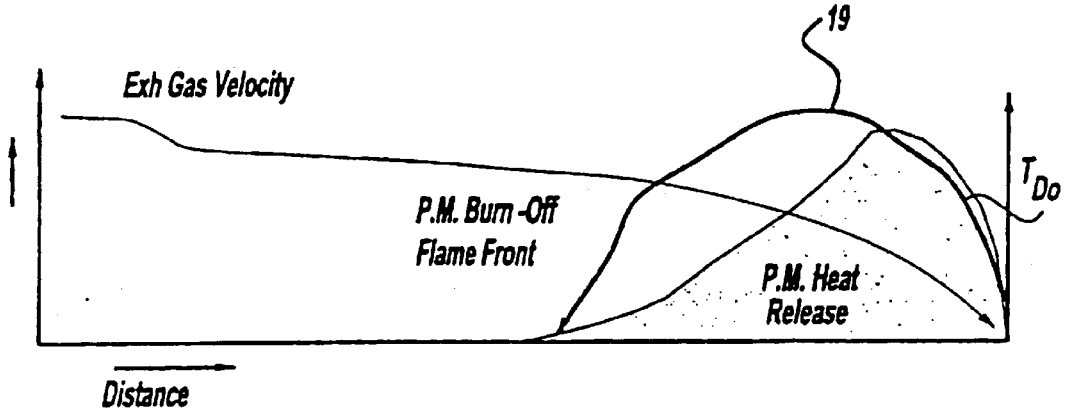
FIG. 5 is a plot detailing the exhaust gas velocity, flame front, and heat release generated by the end plug heating illustrated in FIG. 4.
Figure 4:
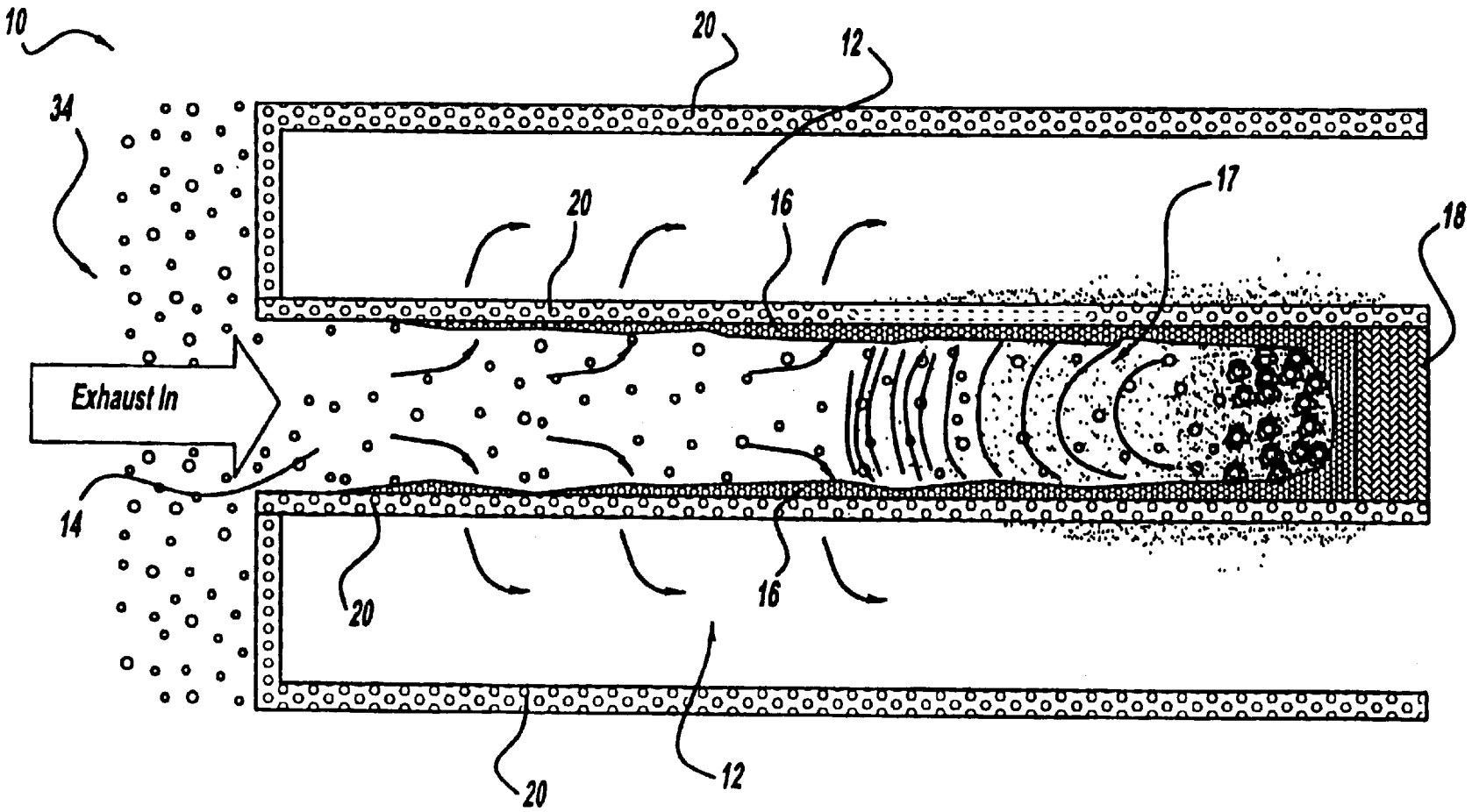
FIG. 4 is a diagrammatic drawing illustrating end plug heating in a particulate trap.

FIGS. 4 and 5 illustrate end plug heating in a particulate trap 10 of the present invention. The end plug 18 in FIG. 4 is comprised of a microwave-absorbing material. The diesel exhaust is filled with particulates 34 and flows through the honeycomb ceramic walls 20 depositing soot 16 upon the upstream walls 20 of the particulate trap 10. Microwaves incident upon the microwave-absorbing plug 18 heat the plug 18, and the heated plug 18 initiates the burn-off of the soot 16 to clear the walls 20 of the particulate trap 10, as seen by waves 17 that represent the flame front of the particulate burn off. In an end plug heating configuration of the present invention, the burn-off will initially occur where the particulate mass or soot 16 is the highest, at the end of the closed end channel 14, and propagate to the rest of the closed end channel 14. The exotherm of a relatively small amount of particulates, that are ignited by the end plug 18, will be leveraged to burn a relatively large amount of soot.

FIG. 5 illustrates the performance of the particulate trap shown in FIG. 4. The exhaust gas velocity will decrease as a function of the distance of the closed end channel 14. The heat generated by the particulate heat release will initially be localized near the end plug 18 and then propagate as a burn-off flame front shown by arrow 19.

Figure 6:
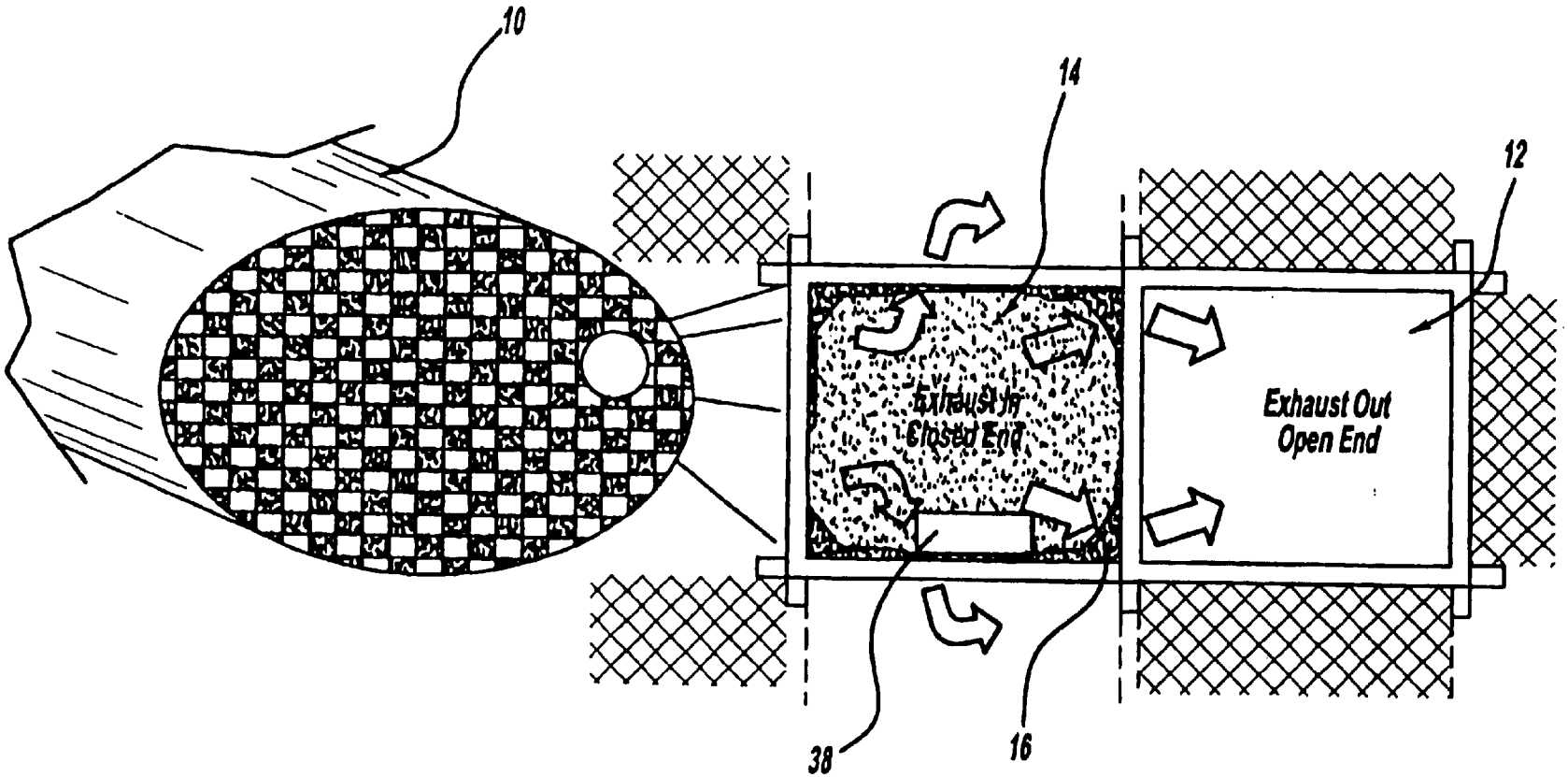
FIGS. 6 and 7 are diagrammatic drawings of a particulate trap utilizing axial channel heating.
Figure 7:
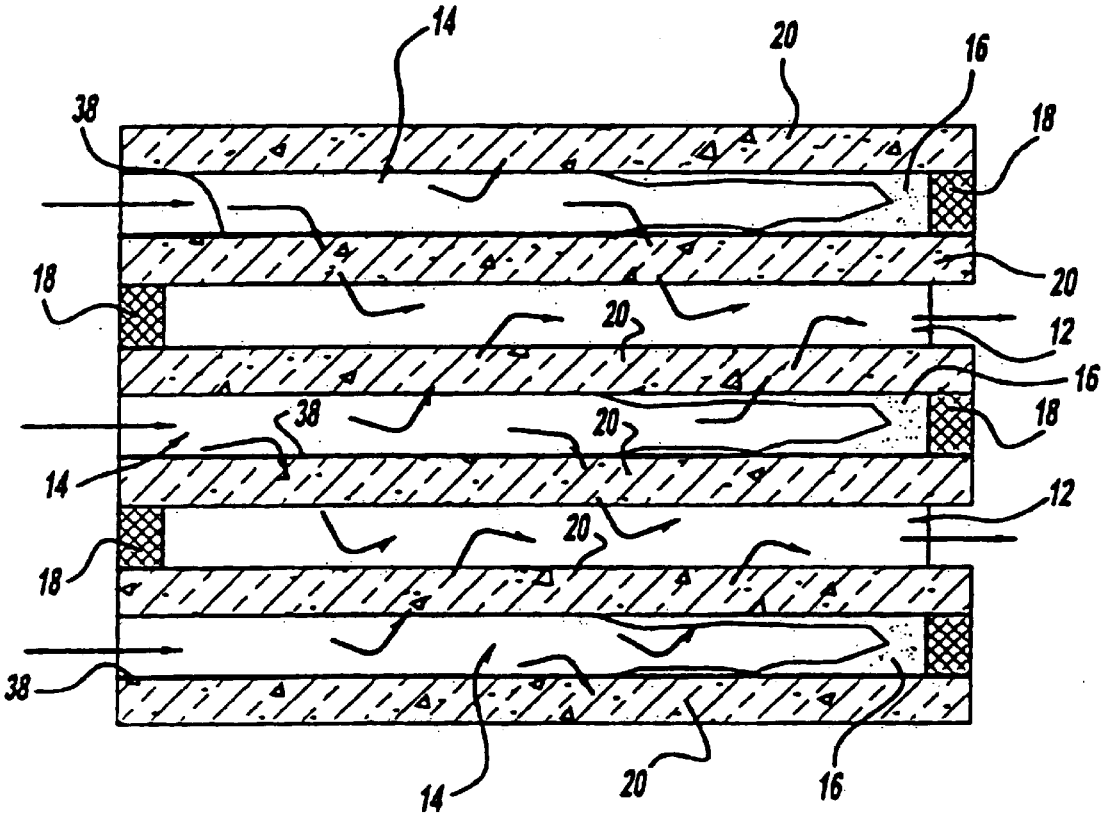

FIGS. 6 and 7 are diagrammatic drawings of a particulate trap 10 utilizing axial channel heating. The particulate trap is similar to the particulate trap 10 shown in FIG. 1 with microwave-absorbing material 38 added to the closed end channels 14. The microwave-absorbing material 38 is deposited linearly along a wall or walls of the closed end channels 14, as seen in FIGS. 6 and 7.

Figure 8:
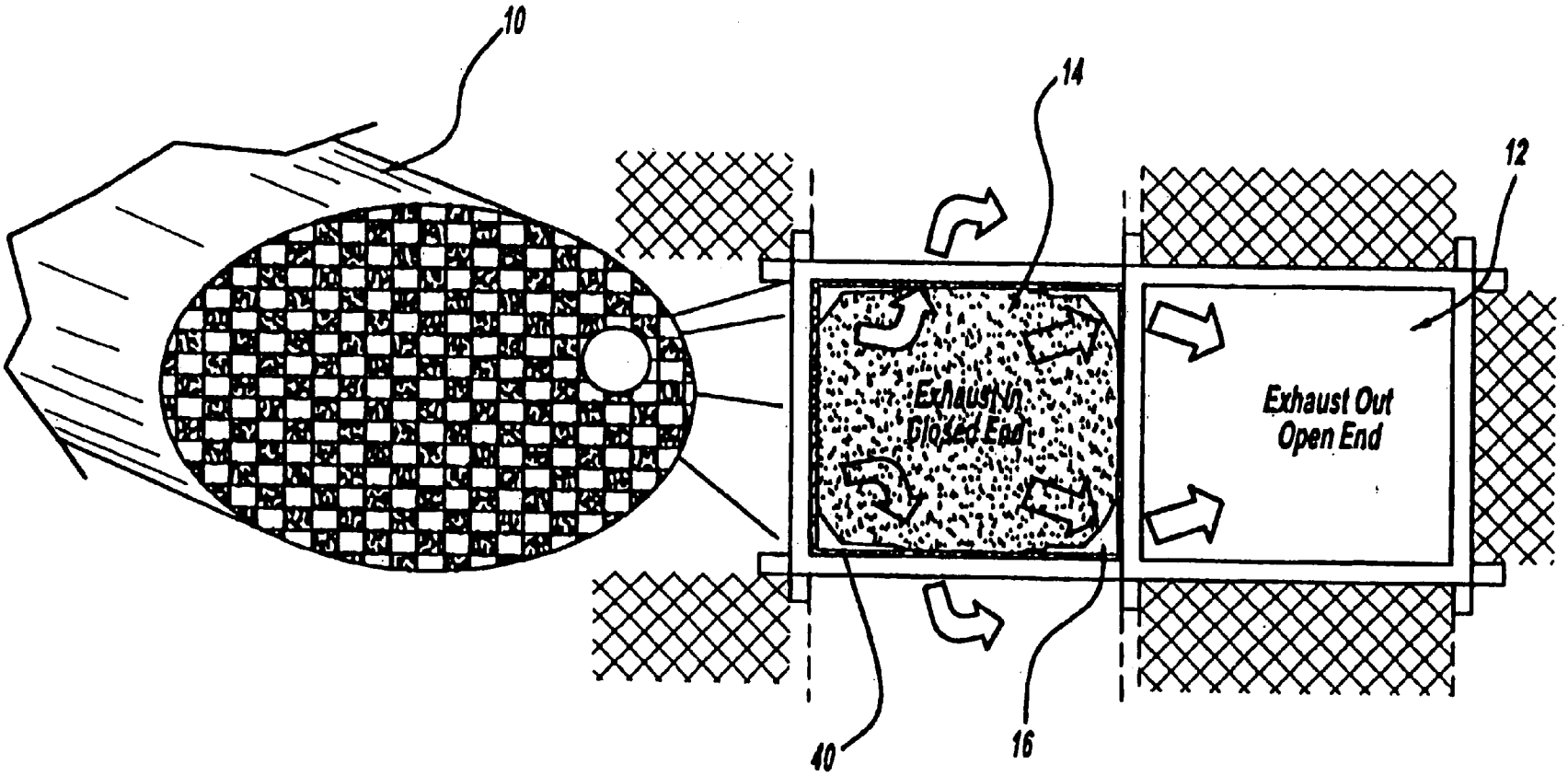
FIGS. 8 and 9 are diagrammatic drawings of a particulate trap illustrating mid-channel banded heating.
Figure 9:
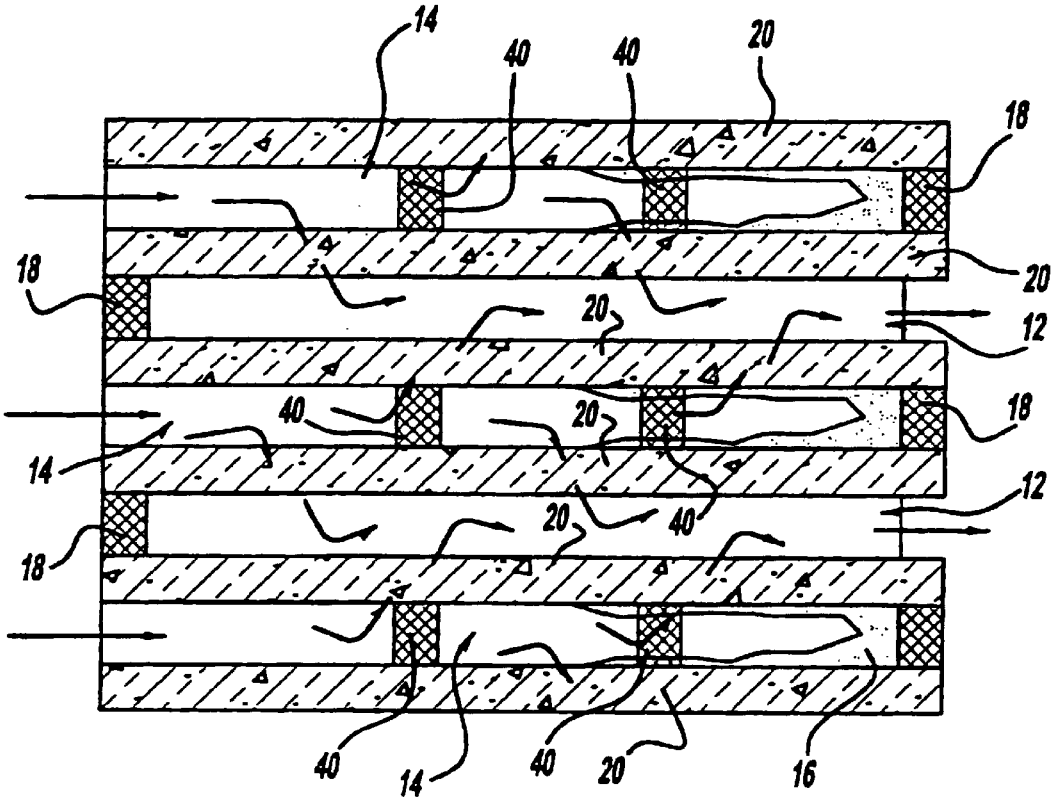
Figure 10:
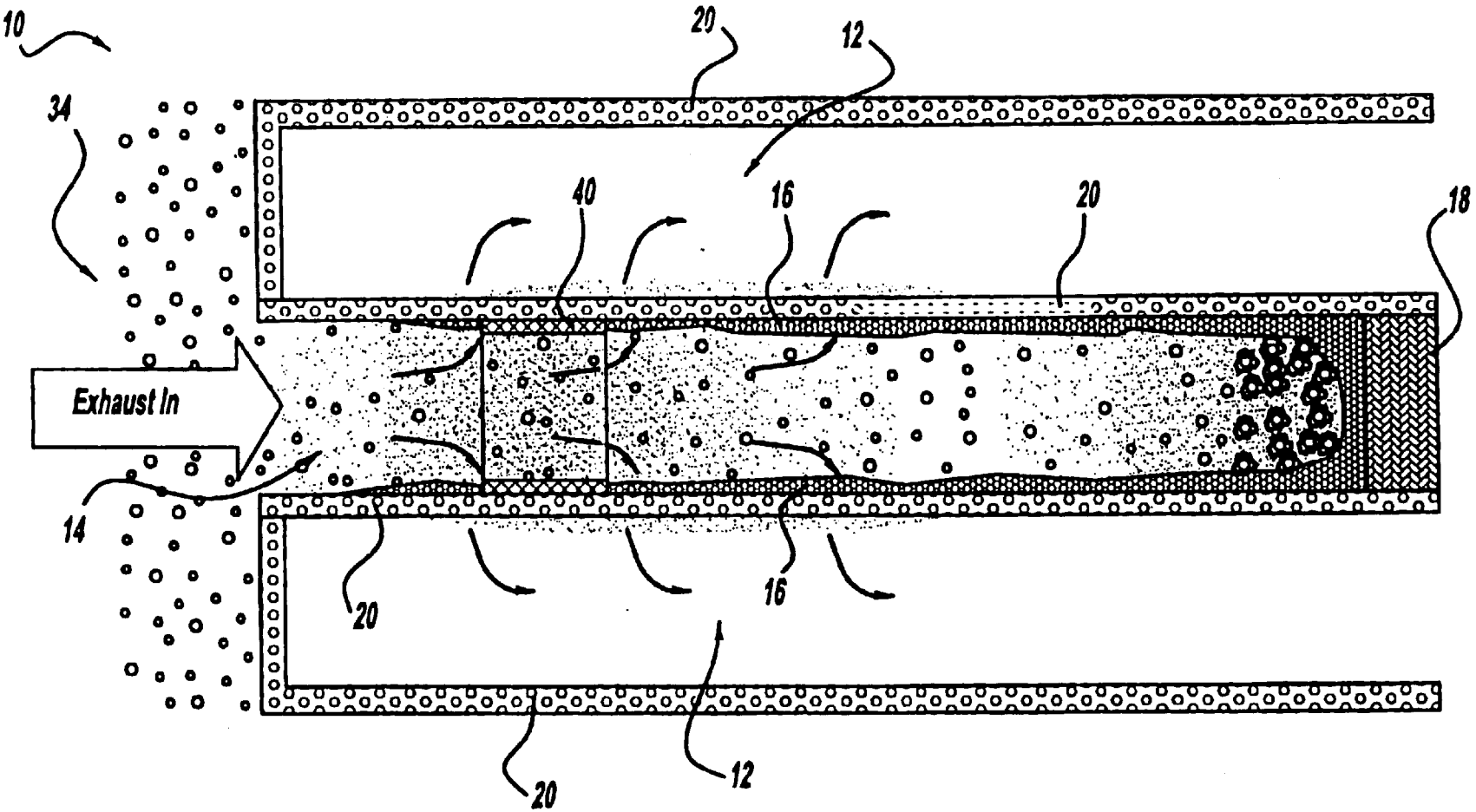
FIG. 10 is a diagrammatic drawing illustrating mid-channel heating in a particulate trap.

FIGS. 8 and 9 are diagrammatic drawings of a particulate trap 10 utilizing mid-channel band heating. The particulate trap is similar to the particulate trap 10 shown in FIG. 1 with bands 40 of microwave-absorbing material added to the closed end channels 14. The microwave-absorbing material bands 40 are deposited in selected areas along the axial flow length of the closed end channels 14, as seen in FIGS. 9 and 10. The exact location of the microwave-absorbing bands 40 on the channel walls and the pattern of channels that are banded can be determined experimentally for the application.

Figure 11:
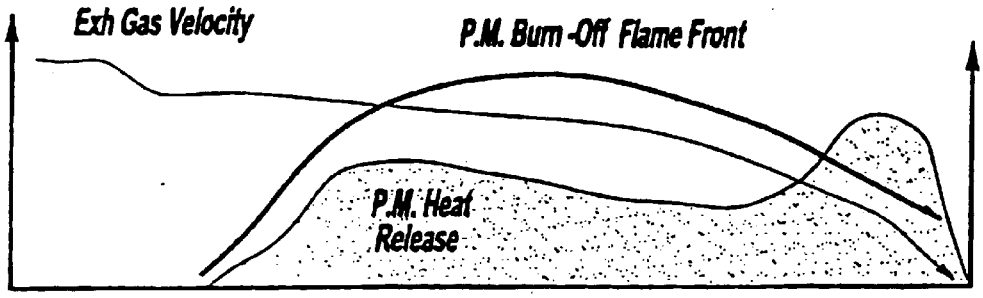
FIG. 11 is a plot detailing the exhaust gas velocity, flame front, and heat release generated by the mid-channel heating of FIG. 10.

FIGS. 10 and 11 illustrate the mid-channel or banded heating in a particulate trap 10 of the present invention. The diesel exhaust is filled with particulates 34 and flows through the honeycomb ceramic walls 20 depositing soot 16 upon the walls 20 of the particulate trap 20. Microwaves incident upon the microwave-absorbing band 40 heat the band 40, and the heated band 40 initiates the burn-off of the soot 16 to clear the walls 20 of the particulate trap 10. In a mid-channel or banded heating configuration of the present invention, the initial burn-off will occur where the bands 40 are placed in a closed end channel 14, as seen in FIG. 10.

FIG. 11 illustrates the performance of the particulate trap 10 shown in FIG. 10. The exhaust gas velocity will decrease as a function of the distance of the closed end channel 14. The heat generated by the particulate heat release will initially be localized near the bands 40 and then propagate as a burn-off flame front shown by arrow 41.

Figure 13:
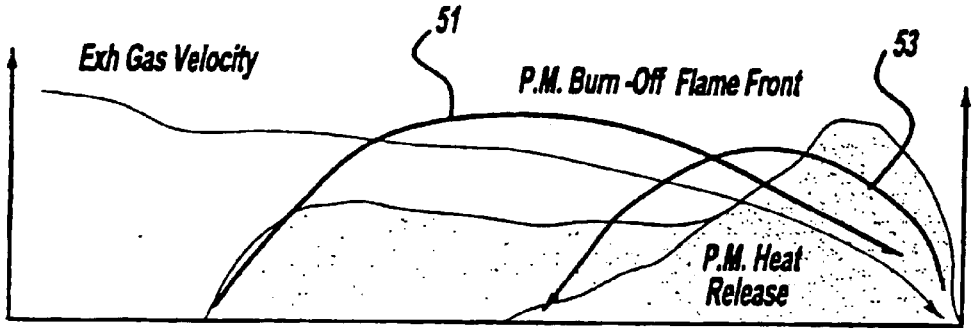
FIG. 13 is a plot detailing the exhaust gas velocity, flame front, and heat release generated by the mid-channel and end plug heating of FIG. 12.
Figure 12:
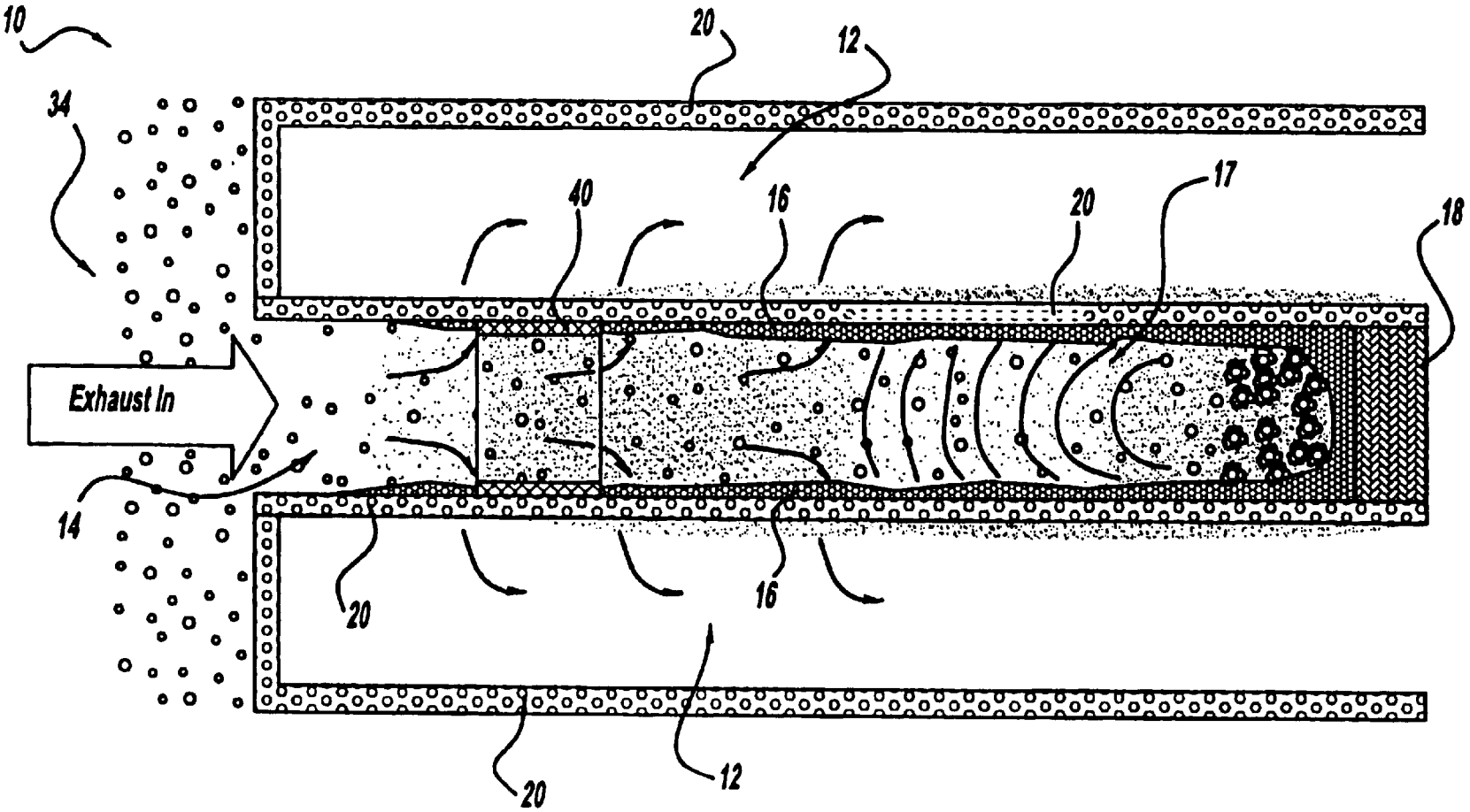
FIG. 12 is a diagrammatic drawing illustrating mid-channel heating combined with end plug heating in a particulate trap.

FIGS. 12 and 13 are diagrammatic drawings of a particulate trap 10 utilizing a combination of banded heating and end plug heating. The particulate trap is similar to the particulate trap 10 shown in FIG. 1 with bands 40 of microwave-absorbing material added to the closed end channels 14 and a microwave-absorbing end plug 18. This combination of microwave-absorbing bands 40 and microwave-absorbing end plugs 18 initiate the burn-off of particulates substantially along the entire length of the closed end channel 14.

FIG. 13 illustrates the performance of the particulate trap 10 shown in FIG. 12. The exhaust gas velocity will decrease as a function of the distance of the closed end channel 14. The heat generated by the particulate heat release will initially be localized near the band 40 and end plug 18 and then propagate as burn-off flame fronts shown by arrows 51 and 53.

It is to be understood that the invention is not limited to the exact construction illustrated and described above, but that various changes and modifications may be made without departing from the spirit and scope of the invention as defined in the following claims.

What is claimed is:

1. A particulate filter for an internal combustion engine comprising:

a microwave source generating microwaves;

microwave-absorbing materials to absorb said microwaves and generate heat;

a particulate trap, having a monolithic honeycomb construction, trapping particulates generated by the engine, said particulate trap heated by said microwave-absorbing materials to burn off said particulates; and wherein said microwave absorbing material is applied to the surface of the particulate trap as axial bands distributed along channels of said particulate trap.

2. The particulate filter of claim 1 wherein said microwave absorbing material is further configured as an end plug.

3. The particulate filter of claim 1 wherein said microwave absorbing material is further deposited in substantially linear fashion along the length of the channels of said particulate trap.

4. The particulate filter of claim 1 wherein said microwave absorbing material is silicon carbide.

5. The particulate filter of claim 1 wherein said particulate tap is comprised of microwave transparent material.

6. The particulate filter of claim 5 wherein said microwave transparent material is cordierite.

7. A method of regenerating a particulate trap having a monolithic honeycomb structure comprising:

generating microwave radiation;

discretely depositing microwave-absorbent material in linear fashion along the walls of the particular trap; and absorbing microwaves with said microwave-absorbent material to generate heat to burn particulates in the particulate trap.

8. The method of claim 7 further comprising the step of configuring microwave-absorbent material as end plugs in the particulate trap.

9. The method of claim 7 further comprising the step of controlling the temperature of the particulate trap by controlling the microwave radiation.

10. A system for removing particulates in a particulate trap comprising:

a microwave power source;

a microwave antenna coupled to said power source for generating microwaves;

a microwave wave guide operatively coupled to said microwave antenna to guide said microwaves; and microwave-absorbent material discretely applied on inner surfaces of said particulate trap, wherein said microwaves are incident upon said microwave-absorbent material to generate heat to burn off particulates located in said particulate trap, and wherein said particulate trap is substantially transparent to microwaves.

11. The system of claim 10 further comprising a diesel engine coupled to said particulate trap, wherein said diesel exhaust propagates through said particulate trap.

12. A method of initiating regeneration in a monolithic honeycomb particulate trap comprising the steps of:

locating microwave-absorbing material as discrete linear segments on the surfaces of channels in the honeycomb of the particulate trap;

generating microwaves;

absorbing microwaves with the microwave absorbing material; and controlling the microwaves to initiate a burn-off of particulates.

* * * * *